US005807161A

United States Patent [19]

Manor et al.

[11] Patent Number: 5,807,161

[45] Date of Patent: Sep. 15, 1998

[54] REVERSIBLE BACK-UP PAD

[75] Inventors: Edward L. Manor, Lakeland, Minn.; David C. Roeker, Hudson, Wis.

[73] Assignee: Minnesota Mining and Manufacturing Company

[21] Appl. No.: 619,946

[22] Filed: Mar. 15, 1996

[51] Int. Cl.[6] ..... B24B 21/18; B24B 33/00; B24B 47/26; B24B 55/00

[52] U.S. Cl. ..... 451/442; 451/526; 451/529; 451/538

[58] Field of Search ..... 451/357, 526, 451/529, 530, 533, 534, 538, 539, 540, 544, 523, 524, 525, 921, 490, 359, 344, 442

[56] References Cited

U.S. PATENT DOCUMENTS

| | | | |
|---|---|---|---|
| 2,286,208 | 6/1942 | Kirchner | 451/538 |
| 2,288,624 | 7/1942 | Holmsten | 451/539 |
| 2,347,210 | 4/1944 | Meeker | 451/538 |
| 2,644,280 | 7/1953 | O'Neil, Jr. | 451/538 |
| 3,522,681 | 8/1970 | Lampert | 451/490 |
| 3,526,065 | 9/1970 | Lee | 451/490 |
| 3,823,516 | 7/1974 | Christian | 451/490 |
| 3,866,361 | 2/1975 | Mauck | 451/490 |
| 3,875,703 | 4/1975 | Clemente | 451/538 |
| 3,998,012 | 12/1976 | Ness | 451/523 |
| 4,617,767 | 10/1986 | Ali | 451/538 |
| 4,631,220 | 12/1986 | Clifton | 451/533 |
| 4,692,958 | 9/1987 | McMakin | 451/490 |
| 4,844,967 | 7/1989 | Goralski et al. . | |
| 4,951,423 | 8/1990 | Johnson | 451/526 |
| 5,109,637 | 5/1992 | Calafut | 451/523 |
| 5,201,785 | 4/1993 | Nagano | 451/538 |
| 5,222,331 | 6/1993 | Manor et al. | 451/524 |
| 5,254,194 | 10/1993 | Ott et al. | 156/176 |
| 5,281,244 | 1/1994 | Wiand | 451/530 |
| 5,309,682 | 5/1994 | Gutknecht et al. | 451/538 |
| 5,383,309 | 1/1995 | Sampietro | 451/533 |
| 5,607,345 | 3/1997 | Barry et al. | 451/539 |

FOREIGN PATENT DOCUMENTS

| | | | |
|---|---|---|---|
| 0 112 405 A1 | 7/1984 | European Pat. Off. | B24D 9/08 |
| 0 397 624 | 11/1990 | European Pat. Off. | B24D 5/00 |
| WO 95/19242 | 7/1995 | WIPO | B24D 9/08 |

*Primary Examiner*—Timothy V. Eley
*Assistant Examiner*—Derris H. Banks
*Attorney, Agent, or Firm*—James J. Trussell

[57] ABSTRACT

A back-up pa supporting and releasably engaging an abrasive article. The back-up pad comprises: a body including a front surface and a back surface in which the front surface comprises a first attachment component thereon and the back surface comprises a second attachment component thereon, and each of the attachment components is adapted for releasable engagement with an abrasive article; a reinforcing plate located within the body between the front surface and the back surface; and tool securing means on the body for securing the back-up pad to a power tool and for selectively orienting the back-up pad in one of a first orientation and a second orientation. When the back-up pad is in the first orientation, substantially the entire front surface is exposed for contacting a workpiece, and when the back-up pad is in the second orientation, substantially the entire back surface is exposed for contacting a workpiece.

39 Claims, 2 Drawing Sheets

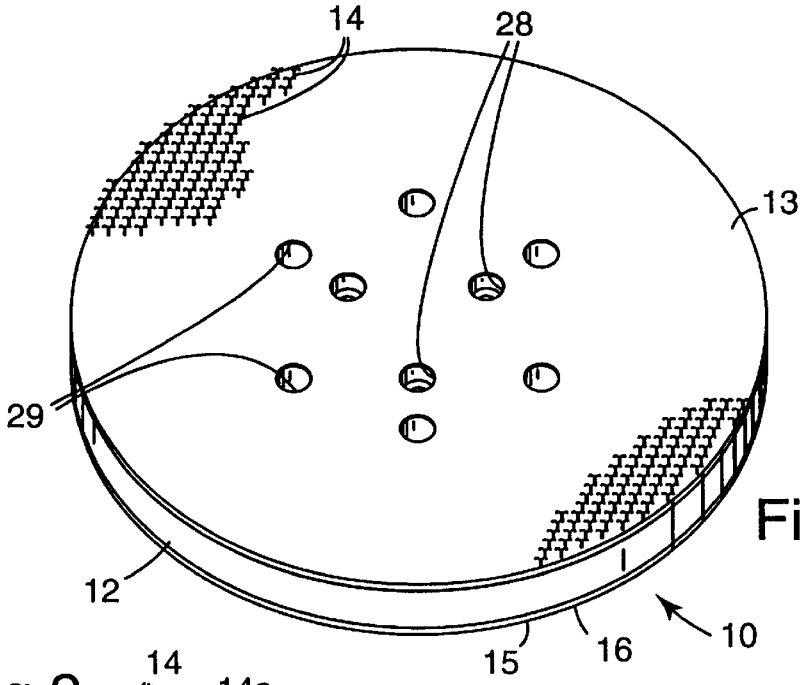
Fig.1
Fig.2
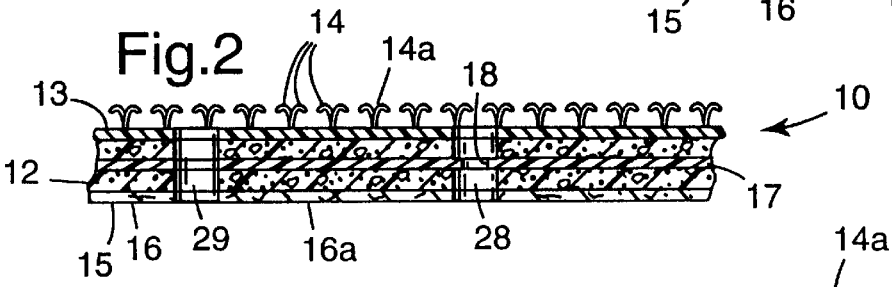
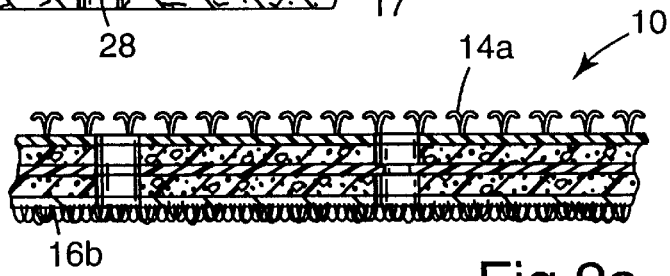
Fig.2a
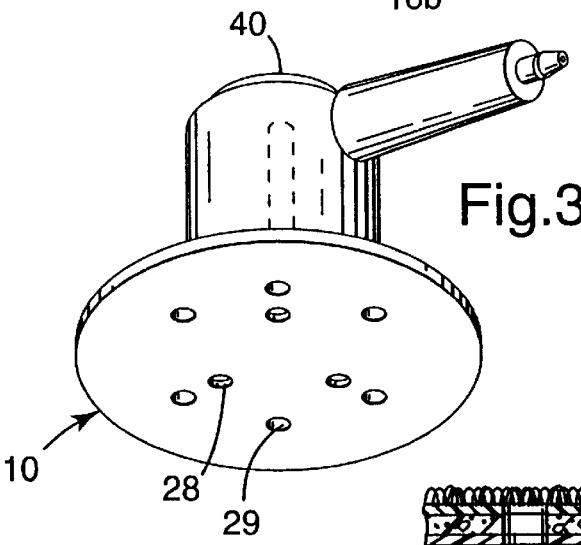
Fig.3
Fig.2b
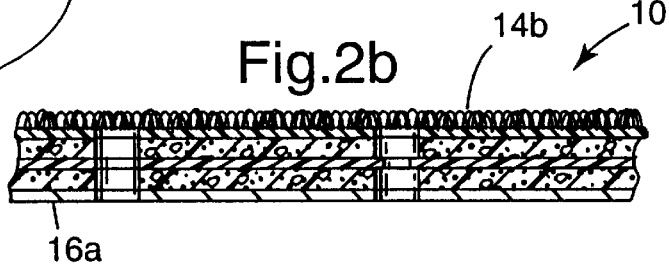

REVERSIBLE BACK-UP PAD

TECHNICAL FIELD

The present invention relates generally to a back-up pad for use with abrasive articles, and more specifically to a reversible back-up pad having opposed attachment components for releasable engagement with abrasive articles.

BACKGROUND OF THE INVENTION

Abrasive articles have long been used in industry for abrading, grinding, and polishing applications. They can be obtained in a variety of converted forms, such as belts, discs, sheets, and the like, in a myriad of sizes.

Generally, when using abrasive articles in the form of "sheet goods", i.e., discs and sheets, a back-up pad is used to mount or attach the abrasive article to the abrading tool. Back-up pads are well known in the abrasive art and are described, for example, in U.S. Pat. Nos. 4,631,220 (Clifton), 4,844,967 (Goralski), and 5,383,309 (Sampietro). Known back-up pads usually have one side on which an abrasive article, such as a disc, is attached. The other side of the back-up pad generally has a bolt or screw extending therefrom to attach the back-up pad to a tool such as a grinder or a sander.

Two common methods of attaching abrasive discs and sheets to back-up pads include pressure sensitive adhesives ("PSAs") and hook and loop fasteners. When the attachment means is a hook and loop system, the abrasive article will have either the loop or the hook component on the backing surface opposite the abrasive coating, and the back-up pad will have the complementary mating component, i.e., the hook or loop. An example of a hook and loop system is available from Minnesota Mining and Manufacturing Company, ("3M") of Saint Paul, Minn. under the trade designation "Hookit". When the attachment means is a PSA (pressure sensitive adhesive), the abrasive article will generally have the adhesive thereon and the back-up pad will typically have a smooth surface such as vinyl or rubber. An example of a PSA system is available from 3M under the trade designation "Stikit". The attaching surfaces of the back-up pads for the hook and loop system and PSA system are incompatible with one another. Thus, an abrasive disc having a loop fabric cannot be directly secured to a back-up pad having a vinyl facing. The abrasive article is sold by the manufacturer with the attachment surface thereon; once incorporated into or onto the abrasive article, the attachment surface cannot be changed.

During an abrading process, an operator often changes from one abrasive article to another. To change from an article having one attachment system to an article having another attachment system, e.g., from a hook and loop to a PSA, the operator must change the back-up pad. A back-up pad designed for one attachment system generally will not securely attach an abrasive article designed for a different attachment system.

Attempts to use a conversion pad to solve the problem of having to change back-up pads have not proved successful or convenient. A conversion pad is a pad or sheet placed on the surface of the back-up pad to change the attachment system. For example, if it is desired to use an abrasive article which has a PSA attachment system with a back-up pad with a hook attachment means, a conversion pad having loops on one surface and vinyl on the other can be attached to the back-up pad and the abrasive article can be attached to the conversion pad. Disadvantages of a conversion pad include the need for a second item, i.e., the conversion pad.

Additionally, the conversion pad changes the perceived hardness of the back-up pad, which can lead to a different cut rate or surface finish when using the abrasive article.

Further, tool manufacturers would prefer to decrease the number of back-up pads in their inventory. Until this invention, the manufacturer had to stock a separate back-up pad for each type of attachment system. Additionally, because power tools are typically stocked and sold in combination with a back-up pad, the manufacturer had to stock a separate tool and back-up pad combination for each type of attachment system.

There is a desire in the industry to have a simple and easy method to change the attachment system on back-up pads without the need for additional tools or back-up pads.

SUMMARY OF THE INVENTION

The present invention is a new and convenient solution for the problem of needing two separate back-up pads when using abrasive articles having different attachment systems.

One aspect of the present invention presents a back-up pad for supporting and releasably engaging an abrasive article. The back-up pad comprises: a body including a front surface and a back surface in which the front surface comprises a first attachment component thereon and the back surface comprises a second attachment component thereon, and each of the attachment components is adapted for releasable engagement with an abrasive article; a reinforcing plate located within the body between the front surface and the back surface; and tool securing means on the body for securing the back-up pad to a power tool and for selectively orienting the back-up pad in one of a first orientation and a second orientation. When the back-up pad is in the first orientation, substantially the entire front surface is exposed for contacting a workpiece, and when the back-up pad is in the second orientation, substantially the entire back surface is exposed for contacting a workpiece.

In one aspect of the above back-up pad, the tool securing means comprises an attachment hole extending through the body and the reinforcing plate. The hole is adapted to receive a securing member inserted therethrough for securing to a power tool. In one preferred embodiment, there are a plurality of attachment holes. In another preferred embodiment, the tool securing means further comprises a threaded insert provided on the reinforcing plate, the threaded insert including an internally threaded hole aligned with the attachment hole.

In another aspect of the above back-up pad, the reinforcing plate is parallel to each of the front surface and the back surface. In another aspect, the reinforcing plate is located equidistant from each of the front surface and the back surface. In yet another aspect, the reinforcing plate comprises polypropylene.

In yet another aspect of the above back-up pad, the first attachment component is of a different type from the second attachment component. In one preferred embodiment of this aspect, the first attachment component is for use with a hook and loop attachment system and the second attachment component is for use with a pressure-sensitive adhesive system. In another preferred embodiment, the first attachment component comprises a loop material adapted to releasably engage a hook material on an abrasive article and the second attachment component comprises a smooth surface adapted to releasably engage a pressure sensitive adhesive on an abrasive article. In yet another preferred embodiment of this aspect, the first attachment component comprises a plurality of hooks adapted to releasably engage a hook engaging material on an abrasive article and the second attachment component comprises a smooth surface adapted to releasably engage a pressure sensitive adhesive on an abrasive article.

In a further aspect of the above back-up pad, the first attachment component comprises a plurality of hooks adapted to releasably engage a hook engaging material on an abrasive article and the second attachment component comprises a loop material adapted to releasably engage hooks on an abrasive article.

In another aspect of the above back-up pad, the body comprises a resilient foam material. In one preferred embodiment of this aspect, the foam material comprises polyurethane.

The present invention also presents a further back-up pad for supporting and releasably engaging an abrasive article which comprises: a resilient body including a front surface and a back surface in which the front surface includes a plurality of hooks thereon adapted to releasably engage a loop material on a back-up pad, and the back surface includes a smooth surface thereon for releasably engaging a layer of adhesive on an abrasive article; a reinforcing plate located within the body between the front surface and the back surface; and tool securing means on the body for securing the back-up pad to a power tool and for selectively orienting the back-up pad in one of a first orientation and a second orientation. When the back-up pad is in the first orientation, substantially the entire front surface is exposed for contacting a workpiece, and when the back-up pad is in the second orientation, substantially the entire back surface is exposed for contacting a workpiece. In one preferred embodiment, the tool securing means comprises an attachment hole extending through the body and the reinforcing plate. The hole is adapted to receive a securing member inserted therethrough for securing to a power tool.

The present invention also presents yet a further back-up pad for supporting and releasably engaging an abrasive article, which comprises: a resilient body including a front surface and a back surface in which the front surface includes a plurality of hooks thereon adapted to releasably engage a loop material on an abrasive article, and the back surface includes a loop material thereon adapted to releasably engage a hook material on an abrasive article; a reinforcing plate located within the body between the front surface and the back surface; and tool securing means on the body for securing the back-up pad to a power tool and for selectively orienting the back-up pad in one of a first orientation and a second orientation. When the back-up pad is in the first orientation, substantially the entire front surface is exposed for contacting a workpiece, and when the back-up pad is in the second orientation, substantially the entire back surface is exposed for contacting a workpiece. In one preferred embodiment, the tool securing means comprises an attachment hole extending through the body and the reinforcing plate. The hole is adapted to receive a securing member inserted therethrough for securing to a power tool.

The present invention presents still another back-up pad for supporting and releasably engaging an abrasive article, comprising: a body including a front surface and a back surface, in which the front surface includes a first attachment component adapted to releasably engage an abrasive article, and the back surface includes a second attachment component adapted to releasably engage an abrasive article; a reinforcing plate located within the body between the front surface and the back surface; a plurality of body attachment holes extending through the body and the first and second attachment components; and a plurality of plate attachment holes extending through the reinforcing plate and aligned with the body attachment holes. The plate attachment holes have a diameter smaller than the body attachment holes, thereby forming a lip adapted to receive the head of a securing member inserted through the body attachment holes and the plate attachment holes to secure the back-up pad to a power tool in a selected one of a first orientation and a second orientation. When the back-up pad is in the first orientation, substantially the entire front surface is exposed for contacting a workpiece, and when the back-up pad is in the second orientation, substantially the entire back surface is exposed for contacting a workpiece.

In one preferred embodiment of the above back-up pad, the first attachment component comprises a plurality of hooks adapted to releasably engage a loop material on an abrasive article, and the second attachment component comprises a smooth surface adapted to releasably engage a layer of adhesive on an abrasive article. In another preferred embodiment, the first attachment component comprises a loop material adapted to releasably engage a hook material on an abrasive article, and the second attachment component comprises a smooth surface adapted to releasably engage a layer of adhesive on an abrasive article. In yet another preferred embodiment, the first attachment component comprises a plurality of hooks adapted to releasably engage a loop material on an abrasive article, and the second attachment component comprises a loop material adapted to releasably engage a hook material on an abrasive article.

The present invention also presents a further back-up pad which comprises: a body including a front surface and a back surface, in which the front surface includes a first attachment component adapted to releasably engage an abrasive article, and the back surface includes a second attachment component adapted to releasably engage an abrasive article; a reinforcing plate located within the body between the front surface and the back surface; an attachment hole extending through the body, the reinforcing plate, and the first and second attachment components; and a threaded insert provided on the reinforcing plate, the threaded insert including an internally threaded hole aligned with the attachment hole and adapted to receive a threaded securing member therethrough to secure the back-up pad to a power tool in a selected one of a first orientation and a second orientation. When the back-up pad is in the first orientation, substantially the entire front surface is exposed for contacting a workpiece, and when the back-up pad is in the second orientation, substantially the entire back surface is exposed for contacting a workpiece.

In one preferred embodiment of the above back-up pad, the first attachment component comprises a plurality of hooks adapted to releasably engage a loop material on an abrasive article, and the second attachment component comprises a smooth surface adapted to releasably engage a layer of adhesive on an abrasive article. In another preferred embodiment, the first attachment component comprises a loop material adapted to releasably engage a hook material on an abrasive article, and the second attachment component comprises a smooth surface adapted to releasably engage a layer of adhesive on an abrasive article. In yet another preferred embodiment, the first attachment component comprises a plurality of hooks adapted to releasably engage a loop material on an abrasive article, and the second attachment component comprises a loop material adapted to releasably engage a hook material on an abrasive article.

BRIEF DESCRIPTION OF THE DRAWINGS

The present invention will be further explained with reference to the appended Figures, wherein like structure is referred to by like numerals throughout the several views, and wherein:

FIG. 1 is an isometric view of a back-up pad of the present invention.

FIG. 2 is a cross-section of one embodiment of a back-up pad of the present invention.

FIG. 2*a* is a cross-section of an alternative embodiment of a back-up pad of the present invention.

FIG. 2*b* is a cross-section of an other alternative embodiment of a back-up pad of the present invention.

FIG. 3 is an isometric view of a back-up pad of the present invention mounted on a rotary tool.

DETAILED DESCRIPTION OF THE INVENTION

Figure 4:
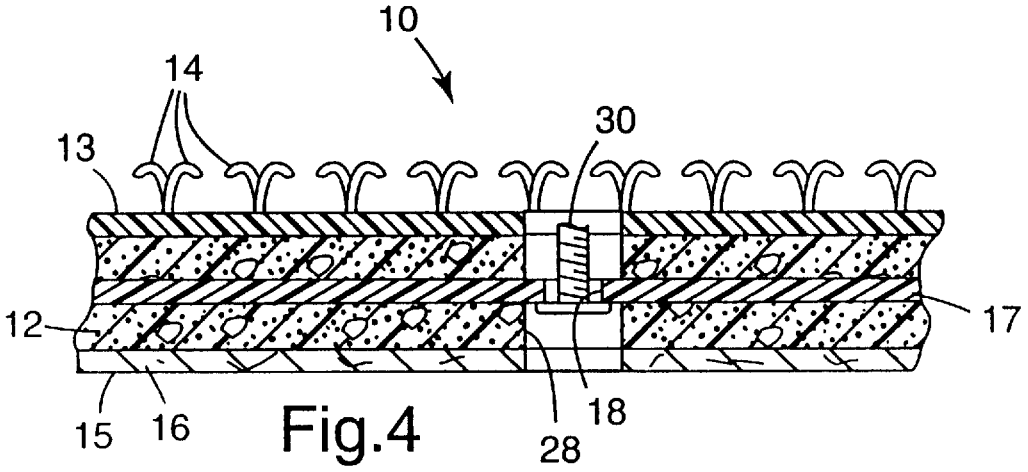
FIG. 4 is a partial cross-section of the back-up pad of FIG. 3 with a securing member.

FIG. 1 illustrates one preferred embodiment of a back-up pad 10 of the present invention. Back-up pad 10 comprises a body 12 having generally parallel front surface 13 and back surface 15. First attachment component 14 is on front surface 13, and second attachment component 16 is on back surface 15. Positioned within body 12 between front surface 13 and back surface 15 is reinforcing plate 17 (See FIG. 2). In one preferred embodiment, shown in FIG. 2 first attachment component 14 comprises hooks 14*a* (for use with a hook and loop attachment system) and second attachment component 16 comprises a smooth surface 16*a* (for use with a PSA attachment system).

In another preferred embodiment, shown in FIG. 2*a*, first attachment component 14 comprises hooks 14*a* (for use with a hook and loop attachment system) and second attachment component 16 comprises loops 16*b* (for use with a hook and loop attachment system). In yet another preferred embodiment, shown in FIG. 2*b*, first attachment component 14 comprises loops 14*b* (for use with a hook and loop attachment system) and second attachment component 16 comprises a smooth surface 16*a* (for use with a PSA attachment system).

The body 12 of the back-up pad is preferably a resilient material such as a flexible foam, for example, polyurethane, polyester, polyester-urethane, polyetherurethane, a natural or artificial rubber such as a polybutadiene, polyisoprene, EPDM polymer, polyvinylchloride (PVC), polychroloprene, or styrene/butadiene copolymer. The foam can be open or closed cell. Additives, such as coupling agents, toughening agents, curing agents, antioxidants, reinforcing materials, and the like can be added to the foam formulation to achieve the desired characteristics. Dyes, pigments, fillers, anti-static agents, fire retardants, and scrim can also be added to the foam.

Particularly useful foams include TDI (toluene diisocyanate)/polyester and MDI (methylene diphenyl diisocyanate)/polyester foams. A preferred foam is a resilient, open cell polyurethane foam formed as the reaction product of a polyether polyol and an aromatic polyisocyanate. In a preferred embodiment of the aforementioned foam, the aromatic polyisocyanate includes methylene diphenyl diisocyante (MDI). Further details on this preferred foam are disclosed in commonly-assigned co-pending U.S. patent application Ser. No. 08/567,130 (Keipert) filed Dec. 4, 1995, the entire disclosure of which is incorporated herein by reference.

One method for forming the back-up pad 10 of the present invention is to form the foam body 12 in situ within a mold in which the desired attachment components 14, 16 have been placed. That is, a mold having the final desired dimensions of the back-up pad is filled with foam and the foam is allowed to cure. The attachment components 14, 16 are inserted into the mold either before the foam is injected into the mold or after the foam is injected but before it has completely cured. Alternately, the foam can be cured and removed from the mold, after which the desired attachment components 14, 16 are adhered to the front and back surfaces 13, 15 of the foam body. Conventional foam machines useful for this method of back-up pad manufacture generally come in two varieties. The first type is a "low pressure" machine which relies on a mechanical mixing device in the dispensing head to mix two component streams, which when mixed, react to create the foam. A second type of foam machine is a "high pressure" or impingement mixing machine. In this type of device, mixing is achieved by impingement of two high velocity component streams within the mixing chamber. Methods of using such foam machines are known in the art.

In an alternate method for forming the back-up pad, pre-fabricated foam in sheet form can be converted, that is, cut to the desired final configuration of the body 12. The attachment components are then laminated onto the body 12 to form the back-up pad 10 of the present invention. Alternately, the attachment components can be laminated onto one or both faces of foam sheeting with a suitable adhesive and then the laminated composite (foam and attachment components) can be converted to the desired shape.

Typically, the hardness and other physical properties of the body are tailored to the desired abrading application. For example, in polishing applications it may be desired to used a softer, more flexible material for the body. Conversely, in more severe polishing applications, it is typically desired to use a hard, stiffer material such as a hard rubber. Since the back-up pad is designed for use with power tools, the body should be made from a material that is capable of withstanding the intended rotational speeds. Typical speeds for a power driven rotary tool are 5,000 to 15,000 rpm, although faster and slower speeds are also used. The body of the back-up pad may alternately be selected from other rigid materials such as wood, plastic, metal, rubber, and the like.

The front surface 13 and back surface 15 each are adapted for supporting abrasive articles. In one preferred embodiment, the first attachment component 14 is of a different type from the second attachment component 16. However, both surfaces may have the same type of attachment system. Having the same attachment system on each side doubles the life of the back-up pad, because when the attachment system on one side is worn or deteriorated past its usefulness, the back-up pad can be reversed to expose the un-used attachment system on the other side.

Preferred attachment systems for attachment components 14, 16 include mechanical fastening systems such as hook and loop systems, and adhesive systems. Examples of hooks adapted to releasably engage loop materials, i.e., hook and loop systems, useful in the present invention include mushroom hooks, "J" hooks, stalks, and "T" hooks. Commercially available hooks useful for the present invention for releasably engaging loop-backed abrasives include various hooks available from manufacturers such as Kanebo Belitouch Ltd. (of Osaka, Japan), and Velcro Inc. (of Manchester, N.H.). Examples of three particularly preferred hooks are disclosed in PCT Application having Publication No. WO 95/19242 published Jul. 20, 1995, the entire disclosure of which is incorporated herein by reference.

Examples of hookengaging materials adapted to releasably engage hook-backed abrasives include loop materials commonly known as stitched loop, brushed loop, formed loop, tricot loop, and the like. Commercially available loops useful for the present invention include various loops available from manufacturers such as Kanebo Belltouch Ltd. (of Osaka, Japan), Guilford Mills (of Greensboro, N.J.), and Woodeaves, Ltd. (of Lancaster, England). A back-up pad having a highly durable and preferred loop system is disclosed in commonly assigned co-pending U.S. patent application Ser. No. 08/560,491 (Sheffield et al.), filed Nov. 17, 1995, the entire disclosure of which is incorporated herein by reference. For a hook and loop attachment system, either the hook component or the loop component can be on one surface of the back-up pad. Hooks adapted to releasably engage a complementary hook material, i.e., attachment systems where two hooks engage such as the system available under the trade designation of "Dual Lock" from 3M, can also be used for the back-up pad of the present invention.

Adhesive systems useful with the back-up pad of the present invention include pressure sensitive adhesives. Typically, the abrasive article has a pre-coated layer of adhesive on the side opposite the abrasive coating. The back-up pad typically includes a smooth surface such as vinyl or rubber for receiving the abrasive article. The adhesive layer on the abrasive article can be adhered to the complementary mating surface of the back-up pad. The abrasive article can then be easily removed when desired. The arrangement of the adhesive and vinyl components on the abrasive article and back-up pad may be reversed. One preferred PSA attachment system is the "Stikit" attachment system from 3M. Another adhesive attachment system includes the use of an adhesive commonly known as a "feathering adhesive". With this system, the abrasive article initially has no adhesive, e.g., PSA, thereon. The feathering adhesive is applied (typically from a tube) onto either the abrasive article backing or the surface of the back-up pad, or both. The abrasive article is then attached to the back-up pad. After using the abrasive article, the article is removed from the back-up pad, and another article is attached to the back-up pad with or without adding additional feathering adhesive.

The back-up pad surface used for both feathering adhesives and PSAs is generally a smooth non-porous surface, such as vinyl, rubber, or metal, although other surfaces are suitable. In some feathering applications, cloth mating surfaces are preferred. Examples of adhesives suitable for both a, PSA or a feathering adhesive include latex crepe, rosin, acrylic polymers and copolymers (e.g., polybutylacrylate), polyacrylate ester, vinyl ethers (e.g., polyvinyl n-butyl ether), vinyl acetate adhesives, alkyd adhesives, rubber adhesives (e.g., natural rubber, synthetic rubber, chlorinated rubber), and mixtures thereof. One preferred pressure sensitive adhesive is an isooctylacrylate:acrylic acid copolymer.

In one preferred embodiment, one attachment component of the back-up pad 10 is adapted for attachment of abrasive articles with an adhesive system and the other attachment component is adapted for attachment of abrasive articles with a hook and loop system. In another preferred embodiment, one surface of the back-up pad 10 includes a hook component for engagement with a loop-backed abrasive article, and the other surface of the back-up pad includes a loop component for engagement with a hook-backed abrasive article. It is understood that any combination of like or different attachment system components 14, 16 can be provided on the surfaces 13, 15 of the back-up pad 10.

The abrasive articles useful for attachment to the back-up pad of the present invention are not particularly limited, although they generally will be a conformable sheet or sheet-like configuration for most applications. At least one major face of the abrasive article will have an abrasive coating thereon, or the abrasive coating, i.e., abrasive grains, can extend throughout the thickness of the article, such as in a lofty non-woven abrasive article. The abrasive articles usable in the invention include, but are not limited to, coated abrasive articles, structured abrasives, non-woven abrasives, slurry coated abrasive articles, buffing pads, and polishing pads. These articles are known in the abrasives art.

The back-up pad is preferably adapted for use with a power tool, such as, for example, an orbital sander, random orbital sander, rotary sander, dual action sander, vibratory sander, and corner sander. The back-up pad can be any shape which will adapt to the tool being used. Well known tool manufactures include Black & Decker, Ryobi, Porter Cable, DeWalt, Skil, Aro and Dynabrade. Usable shapes for back-up pad 10 include circles, ellipses, rectangles (including squares), triangles, hexagons, and the like. The back-up pad may optionally have holes and channels therein for is collecting dust, debris, and swarf, as is well known in the art. The back-up pad 10 is generally between about 2.5 cm and 30 cm in diameter (measured across the longest dimension), preferably between about 7.5 and 20 cm. The thickness of the back-up pad is selected to provide the desired properties from the back-up pad and is generally equal throughout the pad, although there may be some instances where a tapered or sectional back-up pad may be desired. The back-up pad is generally between about 0.5 cm and 10 cm thick, preferably between about 0.9 and 5 cm. The peripheral side walls or edges of the pad are preferably perpendicular, but can be at an angle so as to provide a tapered pad. Back-up pads larger or smaller than those just described also are within the scope of the present invention.

FIG. 1 further shows back-up pad 10 as having body attachment holes 28 and optional dust collection holes 29 passing through body 12. FIG. 2 is a close up view of a cross section of a portion of the back-up pad of the present invention. Reinforcing plate 17 is shown between front surface 13 and back surface 15. Attachment hole 28 and optional dust collection holes 29 pass through back-up pad 10 from front surface 13 through reinforcing plate 17 to back surface 15. The holes also pass through the first and second attachment components 14, 16 which are illustrated schematically and can comprise a component of any desired attachment system.

The reinforcing plate 17 may be selected from a variety of rigid materials, such as for example, polymeric materials (including thermoplastics, thermosets, epoxies), metal (including aluminum, steel, iron, magnesium), wood, fiberglass, and impregnated materials (for example, phenolic impregnated canvas). A preferred plate material is polypropylene. The plate is generally between about 0.25 mm and 15 mm thick, preferably between about 0.5 and 5 mm. The thickness of the plate may be increased or decreased to provide the desired weight, strength, and flexibility to the pad. The plate 17 is preferably parallel to the front and back surfaces 13, 15 of the back-up pad, and preferably extends from the center to the peripheral edge. However, the plate 17 may have a smaller diameter than the body 12, resulting in an annular portion of the back-up pad having no reinforcing plate therein. Lack of a reinforcing plate at the outer edge of the pad generally increases the flexibility and bendability of the outer edge of the pad, which is desirable in certain polishing applications. In one preferred embodiment, the plate 17 is equidistant from each of front surface 13 and back surface 15. For some intended uses, it may be desired that the reinforcing plate is located closer to one surface of the back-up pad than the other. Polishing applications generally require a softer, more compressable back-up pad than harsher grinding applications. By having the reinforcing plate located closer to one surface than the other, one side of the pad can be used for polishing while the other is used for grinding.

Examples of tools with which the back-up pad of the present invention can be used include sanders such as orbital sanders, random orbital sanders, rotary sanders, dual action sanders, vibratory sanders, and corner sanders. Typical speeds for a power driven rotary tool are 5,000 to 15,000 rpm, depending on the back-up pad size and type of power tool. Typical oscillation speeds for a power driven vibratory sander are about 12,000 oscillations/second, and for a corner sander are about 3,000 to 5,000.

The back-up pad 10 of the present invention also includes a tool securing means for securing the back-up pad to a power tool. The securing means must be strong enough to keep the back-up pad 10 securely attached to the power tool during the abrading or polishing process. The securing means of the present invention allows the back-up pad 10 to be secured to a power tool in either of two orientations. In the first orientation, the front surface 13 with first attachment component 14 faces away from the power tool. This exposes substantially the entire front surface for contact with a workpiece. In the second orientation, the back-up pad 10 is reversed such that the back surface 15 with second attachment component 16 thereon faces away from the power tool. This orientation exposes substantially the entire back surface of the body 12 for contact with a workpiece.

In the embodiment illustrated in FIGS. 2–4, plate 17 has plate attachment holes 18 which are aligned with holes 28 in the body 12. A securing member 30, such as a pin, nail, bolt or screw can be inserted through holes 18, 28 and then secured to the drive mechanism of a tool. Such a securing member directly attaches the back-up pad 10 to the drive mechanism of a tool. It is generally preferred that the diameter of the attachment hole 18 in the reinforcing plate is smaller than the diameter of holes 28 extending through the body 12 of the back-up pad. This creates a lip in the plate 17 that provides a rigid surface within the pad, away from the abrading surface, for the head of the securing member to engage. The securing member attaches the back-up pad to the drive mechanism of the rotary tool.

FIG. 3 shows a schematic of power tool 40 with a back-up pad 10 of the present invention attached thereto. Back-up pad 10 is attached to the tool by a securing member inserted through attachment hole 28 as described above with respect to FIG. 2. Back-up pad 10 comprises body 12 having front surface 13 and back surface 15, both surfaces which are adapted for attachment of abrasive articles, and reinforcing plate 17 located within body 12. Back-up pad 10 is attached to power tool 40 by inserting a securing member, such as a bolt, for example, (not illustrated) through attachment hole 28, into, for example, a threaded hole in the tool (not illustrated). The securing member can be any mechanism by which back-up pad 10 is attached to the drive mechanism of the rotary tool. In some embodiments, the securing member preferably has a head thereon, the head having a larger diameter than the rest of the pin, bolt, or screw for engagement with the lip at hole 18 in plate 17, as seen in FIG. 4. In the first orientation, the back-up pad 10 is oriented with back surface 15 facing the power tool and front surface 13 facing away from the power tool. Securing member 30 is then inserted in the attachment hole from the front surface 13, through the body 12, and then into a suitable structure in the power tool, such as an internally threaded hole. To place the back-up pad in its second orientation, the securing member is removed and the orientation of the back-up pad is reversed such that the front surface 13 faces the power tool and the back surface 15 faces away from the power tool. Securing member 30 is then inserted through the attachment hole from the back surface 15, through the body 12, and into the power tool.

Figure 5:
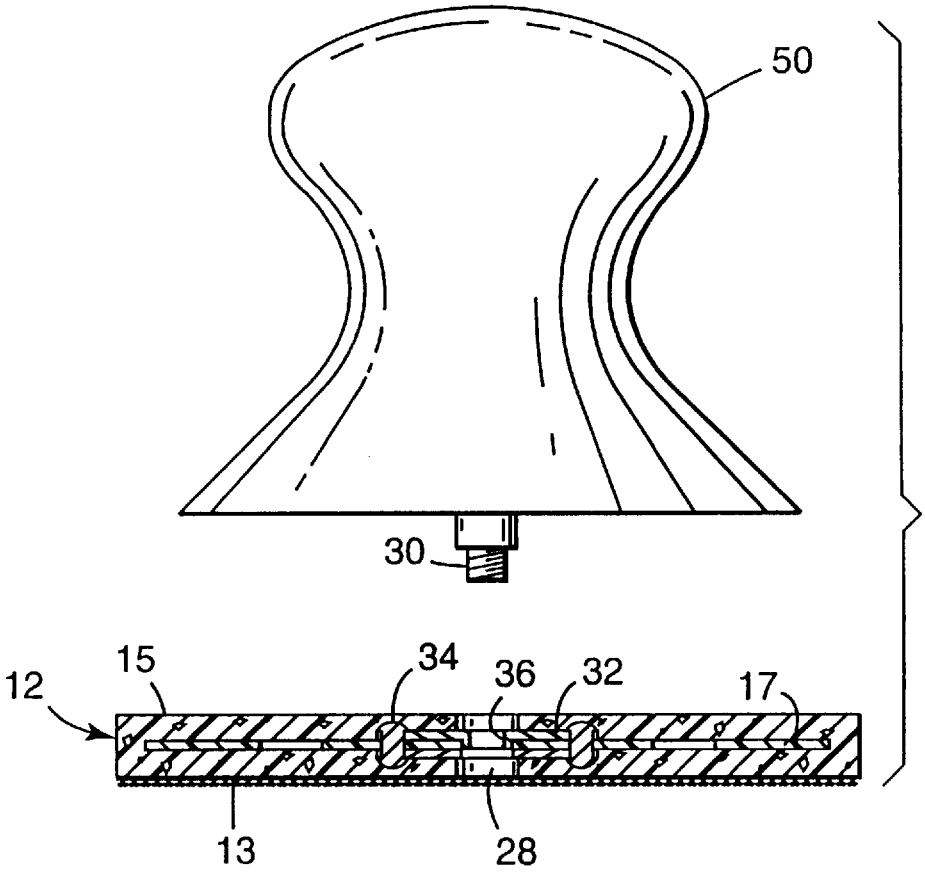
FIG. 5 is a partial cross section of a back-up pad of the present invention and a rotary tool.

FIG. 5 illustrates an alternate embodiment of the present invention, in which a power rotary tool 40 (shown schematically) has a tool securing member 30 extending therefrom for engagement with the back-up pad 10. In this embodiment, securing member 30 is an externally treaded bolt which is adapted for threaded engagement with the internal thread 36 in threaded insert 32. Insert 32 can be secured to plate 17 by any suitable means, such as by rivets 34 as illustrated. Alternatively, plate 17 itself can have an internally threaded hole in the plate which would serve as the threaded insert. In the first orientation, the back-up pad 10 is oriented with back surface 15 facing the power tool and front surface 13 facing away from the power tool. Securing member 30 extending from the power tool is inserted into the threaded insert 32 in the direction from the back surface 15, and the back-up pad is then rotated to engage the threaded securing member 30 with the internal thread 36. To place the back-up pad in its second orientation, the back-up pad is unscrewed from the securing member 30 and removed and the orientation of the back-up pad is reversed such that the front surface 13 faces the power tool and the back surface 15 faces away from the power tool. Securing member 30 extending from the power tool is then inserted into the threaded insert 32 in the direction from the front surface 13, and the back-up pad is then rotated to engage the threaded securing member 30 with the internally thread 36.

It is understood that the back-up pad 10 of the present invention can include any securing means capable of securely attaching the back-up pad to a power tool during the abrading or polishing process and that allows the back-up pad 10 to be secured to a power tool in either of two orientations as described above. While the securing means has been described with reference to preferred embodiments thereof, the present invention is not thereby limited.

It is understood that the back-up pad of the present invention may not be compatible with the method of securing prior back-up pads to power tools, and as such, the power tool should be modified. A preferred method of attaching the back-up pad of the present invention to a tool not designed for this new back-up pad is to use an intermediate chuck or holder which will allow the back-up pad of the present invention to be adapted to most any existing power tool. Generally, such a holder should be able to be attached to the power tool drive means, and then the back-up pad attached to the holder.

The present invention has now been described with reference to several embodiments thereof The foregoing detailed description has been given for clarity of understanding only. No unnecessary limitations are to be understood therefrom. It will be apparent to those skilled in the art that many changes can be made in the embodiments described without departing from the scope of the invention. Thus, the scope of the present invention should not be limited to the exact details and structures described herein, but rather by the structures described by the language of the claims, and the equivalents of those structures.

What is claimed is:

1. A back-up pad for supporting and releasably engaging an abrasive article, comprising:

a resilient body including a front surface and a back surface, wherein said front surface includes a plurality of hooks thereon adapted to releasably engage a loop material on a back-up pad, and wherein said back surface includes a smooth surface thereon for releasably engaging a layer of adhesive on an abrasive article;

a reinforcing plate located within said body between said front surface and said back surface; and tool securing means on said body for securing said back-up pad to a power tool and for selectively orienting said back-up pad in one of a first orientation and a second orientation, wherein when said back-up pad is in said first orientation, substantially the entire front surface is exposed for contacting a workpiece, and wherein when said back-up pad is in said second orientation, substantially the entire back surface is exposed for contacting a workpiece.

2. The back-up pad according to claim 1, wherein said tool securing means comprises an attachment hole extending through said body and said reinforcing plate, wherein said hole is adapted to receive a securing member inserted therethrough for securing to a power tool.

3. The back-up pad according to claim 2, wherein said securing member is selected from the group consisting of a pin, a nail, a bolt, and a screw.

4. The back-up pad according to claim 1, wherein said reinforcing plate is parallel to each of said front surface and said back surface.

5. The back-up pad according to claim 1, wherein said reinforcing plate is located equidistant from each of said front surface and said back surface.

6. The back-up pad according to claim 1, wherein said reinforcing plate comprises polypropylene.

7. The back-up pad according to claim 1, wherein said body comprises a resilient foam material.

8. The back-up pad according to claim 7, wherein said foam material comprises polyurethane.

9. A back-up pad for supporting and releasably engaging an abrasive article, comprising:

a resilient body including a front surface and a back surface, wherein said front surface includes a plurality of hooks thereon adapted to releasably engage a loop material on an abrasive article, and wherein said back surface includes a loop material thereon adapted to releasably engage a hook material on an abrasive article;

a reinforcing plate located within said body between said front surface and said back surface; and tool securing means on said body for securing said back-up pad to a power tool and for selectively orienting said back-up pad in one of a first orientation and a second orientation, wherein when said back-up pad is in said first orientation, substantially the entire front surface is exposed for contacting a workpiece, and wherein when said back-up pad is in said second orientation, substantially the entire back surface is exposed for contacting a workpiece.

10. The back-up pad according to claim 9, wherein said tool securing means comprises an attachment hole extending through said body and said reinforcing plate, wherein said hole is adapted to receive a securing member inserted therethrough for securing to a power tool.

11. The back-up pad according to claim 10, wherein said securing member is selected from the group consisting of a pin, a nail, a bolt, and a screw.

12. The back-up pad according to claim 9, wherein said reinforcing plate is parallel to each of said front surface and said back surface.

13. The back-up pad according to claim 9, wherein said reinforcing plate is located equidistant from each of said front surface and said back surface.

14. The back-up pad according to claim 9, wherein said reinforcing plate comprises polypropylene.

15. The back-up pad according to claim 9, wherein said body comprises a resilient foam material.

16. The back-up pad according to claim 15, wherein said foam material comprises polyurethane.

17. A back-up pad for supporting and releasably engaging an abrasive article, comprising:

a body including a front surface and a back surface, wherein said front surface includes a first attachment component adapted to releasably engage an abrasive article, and wherein said back surface includes a second attachment component adapted to releasably engage an abrasive article;

a reinforcing plate located within said body between said front surface and said back surface;

a plurality of body attachment holes extending through said body and said first and second attachment components; and a plurality of plate attachment holes extending through said reinforcing plate and aligned with said body attachment holes, said plate attachment holes having a diameter smaller than said body attachment holes, thereby forming a lip adapted to receive the head of a securing member inserted through said body attachment holes and said plate attachment holes to secure said back-up pad to a power tool in a selected one of a first orientation and a second orientation, wherein when said back-up pad is in said first orientation, substantially the entire front surface is exposed for contacting a workpiece, and wherein when said back-up pad is in said second orientation, substantially the entire back surface is exposed for contacting a workpiece.

18. The back-up pad according to claim 17, wherein said first attachment component comprises a plurality of hooks adapted to releasably engage a loop material on an abrasive article, and wherein said second attachment component comprises a smooth surface adapted to releasably engage a layer of adhesive on an abrasive article.

19. The back-up pad according to claim 17, wherein said first attachment component comprises a loop material adapted to releasably engage a hook material on an abrasive article, and wherein said second attachment component comprises a smooth surface adapted to releasably engage a layer of adhesive on an abrasive article.

20. The back-up pad according to claim 17, wherein said first attachment component comprises a plurality of hooks adapted to releasably engage a loop material on an abrasive article, and wherein said second attachment component comprises a loop material adapted to releasably engage a hook material on an abrasive article.

21. The back-up pad according to claim 17, wherein said securing member is selected from the group consisting of a pin, a nail, a bolt, and a screw.

22. The back-up pad according to claim 17, wherein said reinforcing plate is parallel to each of said front surface and said back surface.

23. The back-up pad according to claim 17, wherein said reinforcing plate is located equidistant from each of said front surface and said back surface.

24. The back-up pad according to claim 17, wherein said reinforcing plate comprises polypropylene.

25. The back-up pad according to claim 17, where said first attachment component is of a different type from said second attachment component.

26. The back-up pad according to claim 25, wherein said first attachment component is for use with a hook and loop attachment system and said second attachment component is for use with a pressure-sensitive adhesive system.

27. The back-up pad according to claim 17, wherein said body comprises a resilient foam material.

28. The back-up pad according to claim 27, wherein said foam material comprises polyurethane.

29. A back-up pad for supporting and releasably engaging an abrasive article, comprising:

a body including a front surface and a back surface, wherein said front surface includes a first attachment component adapted to releasably engage an abrasive article, and wherein said back surface includes a second attachment component adapted to releasably engage an abrasive article;

a reinforcing plate located within said body between said front surface and said back surface;

an attachment hole extending through said body, said reinforcing plate, and said first and second attachment components; and a threaded insert provided on said reinforcing plate, said threaded insert including an internally threaded hole aligned with said attachment hole and adapted to receive a threaded securing member therethrough to secure said back-up pad to a power tool in a selected one of a first orientation and a second orientation, wherein when said back-up pad is in said first orientation, substantially the entire front surface is exposed for contacting a workpiece, and wherein when said back-up pad is in said second orientation, substantially the entire back surface is exposed for contacting a workpiece.

30. The back-up pad according to claim 29, wherein said first attachment component comprises a plurality of hooks adapted to releasably engage a loop material on an abrasive article, and wherein said second attachment component comprises a smooth surface adapted to releasably engage a layer of adhesive on an abrasive article.

31. The back-up pad according to claim 29, wherein said first attachment component comprises a loop material adapted to releasably engage a hook material on an abrasive article, and wherein said second attachment component comprises a smooth surface adapted to releasably engage a layer of adhesive on an abrasive article.

32. The back-up pad according to claim 29, wherein said first attachment component comprises a plurality of hooks adapted to releasably engage a loop material on an abrasive article, and wherein said second attachment component comprises a loop material adapted to releasably engage a hook material on an abrasive article.

33. The back-up pad according to claim 29, wherein said reinforcing plate is parallel to each of said front surface and said back surface.

34. The back-up pad according to claim 29, wherein said reinforcing plate is located equidistant from each of said front surface and said back surface.

35. The back-up pad according to claim 29, wherein said reinforcing plate comprises polypropylene.

36. The back-up pad according to claim 29, where said first attachment component is of a different type from said second attachment component.

37. The back-up pad according to claim 36, wherein said first attachment component is for use with a hook and loop attachment system and said second attachment component is for use with a pressure-sensitive adhesive system.

38. The back-up pad according to claim 29, wherein said body comprises a resilient foam material.

39. The back-up pad according to claim 38, wherein said foam material comprises polyurethane.

* * * * *